US005599135A

United States Patent [19]

Delaurenti

[11] Patent Number: 5,599,135

[45] Date of Patent: Feb. 4, 1997

[54] ASPHALT SPREADER

[76] Inventor: John Delaurenti, 615 Franklin St. SW., Ronan, Mont. 59864

[21] Appl. No.: 482,417

[22] Filed: Jun. 8, 1995

[51] Int. Cl.[6] ..... E02F 3/76

[52] U.S. Cl. ..... 404/101; 404/110; 172/815; 37/274

[58] Field of Search ..... 404/75, 85, 96, 404/101, 110, 118, 105; 37/266, 271, 272, 274; 172/701.1, 811, 815, 824, 828, 840, 834

[56] References Cited

U.S. PATENT DOCUMENTS

| | | | |
|---|---|---|---|
| 4,723,609 | 2/1988 | Curtis | 172/815 |
| 4,725,163 | 2/1988 | Phillips | 404/101 |
| 4,779,363 | 10/1988 | Boutrais et al. | 172/815 X |
| 4,936,392 | 6/1990 | Kitchin | 172/815 |
| 4,991,662 | 2/1991 | Caron et al. | 172/701.1 |
| 5,392,864 | 2/1995 | Lindenmuth | 172/811 |
| 5,487,428 | 1/1996 | Yamamoto et al. | 37/266 X |

*Primary Examiner*—James A. Lisehora
*Attorney, Agent, or Firm*—Richard C. Conover

[57] ABSTRACT

An asphalt spreader for spreading asphalt into ruts in a roadway. The spreader includes a main blade that has wings on either end to keep asphalt before the blade. The blade also has a wedge-shaped center portion which diverts asphalt toward either side of the blade to direct more asphalt into the ruts. The vertical clearance of the wedge-shaped center portion can be separately adjusted so as to control the amount of asphalt that is laid down in the center portion between the ruts. In addition, the bottom surface of the blade is inclined rearwardly with respect to the blade to form an acute angle with the groundplane.

4 Claims, 2 Drawing Sheets

ASPHALT SPREADER

BACKGROUND OF THE INVENTION

This invention relates to an improved device for spreading asphalt into ruts, and a center area between the ruts, of a worn, paved road.

Older paved roads often develop ruts in the paving after prolonged use. Before the road can be resurfaced, the ruts need to be filled and the area between the ruts built-up to present a relatively level surface for repaving. In the past this has often been accomplished by using a conventional road grader which rolls hot asphalt, placed on the road before the blade, into the ruts. The blade smooths out an area as the blade passes over the asphalt. This has not been an entirely satisfactory solution in the past for several reasons. First, a conventional road grader, which has a blade slanted across a road, directs some of the asphalt being spread to the side of the road. This excess asphalt must be picked up someway to be used again. Second, the bottom of the blade, when the grader is moving forward, scoops upwardly which lifts the hot asphalt up and away from the road. This action does little to break up clods in the asphalt.

Several inventions have suggested using wings at the ends of the blade to keep the material churning in front of the blade without sliding out the rearward end, for instance see U.S. Pat. Nos. 523,134, 3,028,698, and 4,936,392. These inventions all suffer from the same problem when spreading asphalt: they have a surface near the bottom of the blade inclined rearwardly above a groundplane, which surface tends to lift dirt as well as asphalt as the blade is moved forward, a motion which does not break up clods in the asphalt; they have no mechanism to divert asphalt across the entire front of the blade; and they cannot be precisely controlled as to their height above the groundplane.

In other situations, several patents have addressed the problem of distributing on-coming material across the blade by using a wedge-shaped center portion which can divert material to either side of the blade across the entire front of the blade, for instance see U.S. Pat. Nos. 4,991,662 and 5,392,864. Again in these inventions, the bottom surface of the blade is shaped to have a perpendicular surface or a surface inclined forwardly and making an obtuse angle with the groundplane in the forward direction in order to pick up material off the groundplane. This upwardly lifting surface does not favor breaking up clods in the asphalt. Both of these patents illustrate a wedge-shaped center portion that is fixedly attached to the blade with no adjustments being available to compensate for the blade's tilting either forward or backward relative to the prime mover.

In both of these references, the tilt of the blade determines the amount of material escaping under the blade. There is no structure provided to allow for different amounts of asphalt to be distributed on the ground surface along the length of the blade.

None of the patents listed above shows any means to precisely control the space between the blade and the groundplane. When prime movers are shown in these patents, the patents illustrate mechanisms for adjusting the height of the blade using pivoting arms extending between the prime mover and the attached blade. Height of the blade above the groundplane is thus determined by the instantaneous position, springiness, and inflation of the tires of the prime mover. Errors in height adjustment are magnified by the extended distances between the tires of the prime mover and the bottom of the blade. It can be easily seen that more precision is need when laying asphalt.

SUMMARY OF INVENTION

The present invention relates to an asphalt spreader that is mounted on a prime mover so as to spread asphalt into ruts in the paving in a manner which provides a smooth surface for repaving. The asphalt spreader has a blade that has wings on either end to keep asphalt churning before the blade as the blade is moved forward without permitting the asphalt to slide around either end. The blade of the present invention also has a wedge-shaped center portion which diverts asphalt toward either side of the blade to direct more asphalt into the ruts. The vertical clearance of the wedge-shaped center portion can be separately adjusted so as to control the amount of asphalt that is laid down in the center portion between the ruts. In addition the bottom surface of the blade is inclined rearwardly with respect to the blade to form an acute angle with the groundplane. With this orientation the bottom surface tends to break up clods in any asphalt that is escaping under the blade as the grader moves forward.

Wheels, which can be adjusted vertically, are positioned on either side of the blade to control the depth of asphalt escaping under the blade. With the wheels positioned closely to the blade, variations in road heights have only negligible effect on the depth of the asphalt layer being laid as the prime mover drops into chuck holes, bounces on its tires, or rotates around its front tires for any reason. With wheels positioned close to the blade, the clearance between the blade and the groundplane can be precisely adjusted vertically to control the amount of asphalt escaping under the blade.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
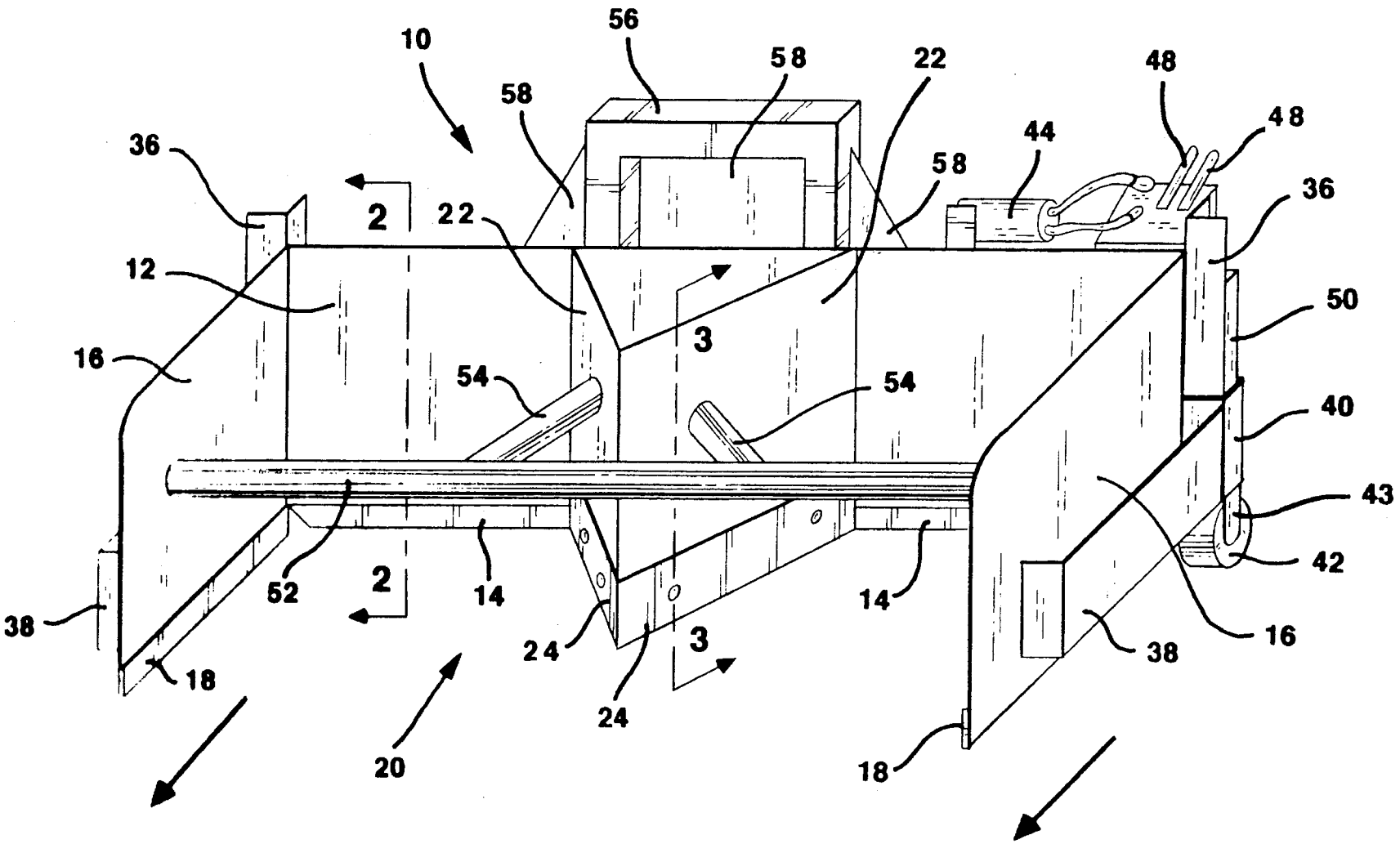
FIG. 1 is a perspective view of the asphalt spreader of the present Invention.
Figure 2:
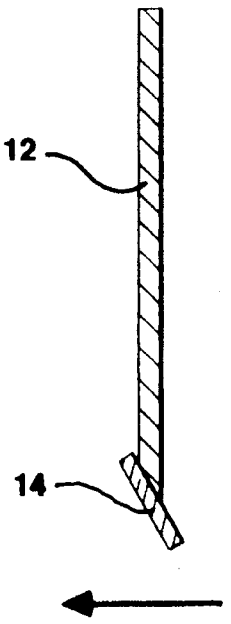
FIG. 2 is a cross-sectional view with background parts broken away and taken along the line 2—2 in FIG. 1.

A preferred embodiment of the asphalt spreader 10 is shown in FIG. 1. Asphalt spreader 10 has a blade 12 which is used to push asphalt in a forward direction from a pile while churning the asphalt in front of the blade. The bottom of blade 12 has scraping surface 14 which is inclined rearwardly with respect to the blade at an acute angle relative to a groundplane as best seen in FIG. 2. The arrow shown in FIG. 2 depicts the direction of forward motion of the blade. Scraping surface 14 also extends across the entire length of blade 12. The inclination of the scraping surface helps to break up clods in the asphalt as the scraping surface smooths the top of any asphalt that escapes under blade 12.

On either end of blade 12, a pair of wings 16 extend forward in the direction of motion. Each wing 16 assists in keeping asphalt in front of blade 12, and prevent asphalt from sliding around an end of the blade. At the bottom of each wing 16, a second scraping surface 18 is attached.

Figure 3:
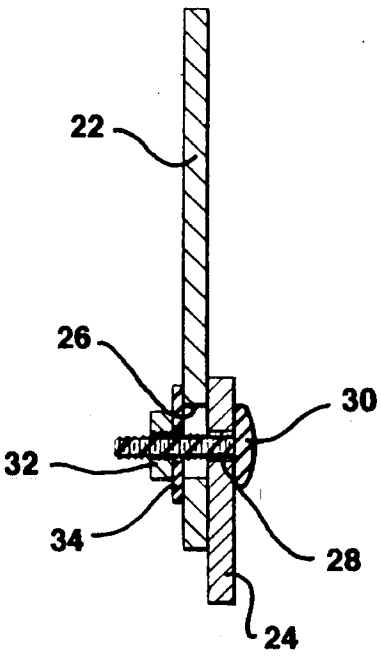
FIG. 3 is a cross-sectional view with background parts broken away and taken along the line 3—3 in FIG. 1.

In the center of blade 12, a wedge-shaped center portion 20 is connected to the blade. The wedge-shaped center portion 20 has walls 22 attached to blade 12 and to each other. Walls 22 divert asphalt to either side of blade 12 as the asphalt spreader moves forward into an elongated pile of asphalt. Walls 22 each have an adjustable third scraping surface 24 which can be adjusted vertically to vary the amount of asphalt being allowed to escape into the area between the ruts. As best seen in FIG. 3, wall 22 has an elongated slot 26 vertically oriented. Bolt hole 28 in third scraping surface 24 holds bolt 30 in place and extends into elongated slot 26. Nut 32 is then tightened against washer 34 to clamp third scraping surface at the desired vertical adjustment relative to wall 22.

Figure 4:
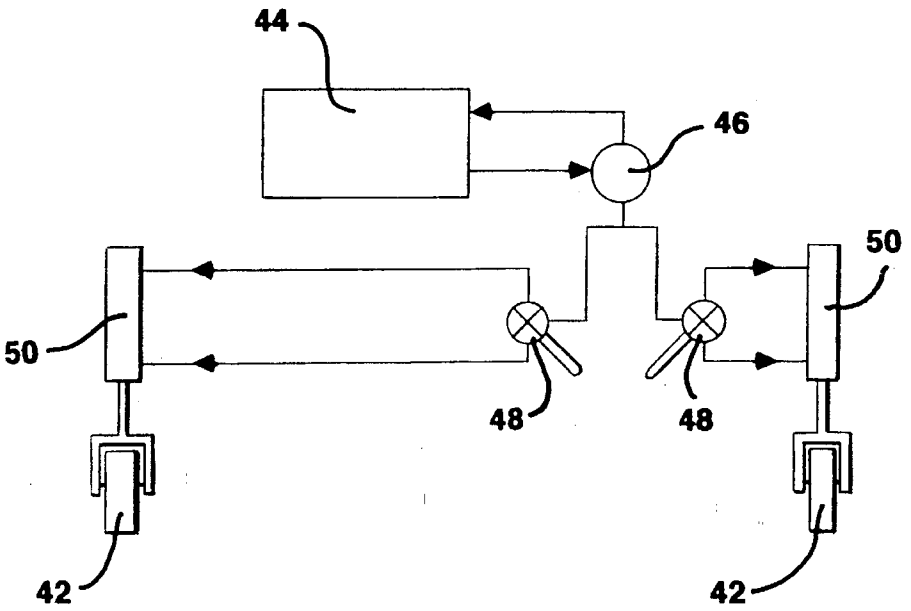
FIG. 4 is a schematic drawing of a hydraulic system used in conjunction with the asphalt spreader shown in FIG. 1.

At either end of blade 22, angle iron corners 36 extend outwardly and rearwardly as best seen in FIG. 1. The corners provide a surface to mount side panels 38 and a wheel housing 40 which makes a box tube in cross-section with corner 36. In a preferred embodiment, wheels 42 are axially connected to a telescoping frame 43 which can be adjusted vertically within wheel housing 40 using a conventional hydraulic power system as shown schematically in FIG. 4. In this conventional system, hydraulic power unit 44 feeds hydraulic fluid under pressure into pressure accumulator 46. Hydraulic pressure is then split and sent to a two-way valve 48 where it can be directed to either end of hydraulic cylinder 50. Since hydraulic cylinder 50 is connected to wheel 42 at one end and corner 36 at the other end, each wheel can be raised, or lowered, independently by action of the hydraulic system. Hydraulic cylinder 50 is also protected by its position within corner 36 and inside of side panel 38. It can be appreciated that other mechanical, or electrical systems could be used equally as effectively in other embodiments, as the hydraulic system described, to raise or lower wheels 42. Adjusting wheels 42 upwardly, or downwardly, independently also permits asphalt spreader 10 to be tilted from side to side across the groundplane if so desired.

Asphalt spreader 10 also has several conventional strengthening braces. A brace 52 is attached between wings 16 to prevent the wings from spreading apart. Wall braces 54 are connected between walls 22 and brace 52 to provide additional strength to walls 22 as they engage a pile of asphalt. A boxed tubing brace 56 is attached to blade 12 to lift asphalt spreader 10 off the groundplane. Plate 58 is attached to boxed tubing brace 56 and has conventional connecting joints (not shown) on its rearward facing face to connect asphalt spreader 10 to the hydraulic actuators of an appropriate prime mover.

In operation, asphalt spreader 10 is connected to a prime mover with a conventional three point hitch. Wheels 42 are independently adjusted, by means of two-way valves 48, to place blade 12 at an appropriate distance above the groundplane. Blade 12 can also be tilted from side-to-side by the independent adjustment of wheels 42. Since, by its connection to the prime mover, asphalt spreader 10 may also be tilted forward or backward relative to the groundplane about an axis extending through axles of wheels 42, further control of the amount of asphalt escaping under blade 12 is provided. In addition, the adjustable scraping surfaces 24 can be manually adjusted to permit a proper amount of asphalt to pass under these surfaces.

A pile of asphalt is first placed in front of asphalt spreader 10 between the ruts in an old paved road and the prime mover moved forward in the direction of movement. As the asphalt from the pile is engulfed in asphalt spreader 10, wedge-shaped center portion 20 diverts asphalt to either side of blade 12 and into the ruts. Second scraping surface 18 keeps asphalt between the two wings 16. Third scraping surface 24 permits some asphalt to escape under the scraping surfaces only to be caught and again escape under first scraping surface 14. The asphalt escaping under third scraping surface 24 is laid in the center area between the two ruts in the roadbed.

The remaining asphalt is churned by blade 12 as asphalt spreader 10 moves forward. Some of the asphalt escapes under blade 12 by passing inclined, first scraping surface 14. First scraping surface 14 is inclined rearwardly at an acute angle to the groundplane to break up any clods that remain in the asphalt as the asphalt escapes and also to smooth the escaping asphalt into the ruts in the road. The asphalt spreader 10 may be tilted forwardly or backwardly or tilted from side to side to control the amount of asphalt escaping under the various scraping surfaces.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. An asphalt spreader for spreading asphalt on a groundplane when moved in a forward direction, the asphalt spreader comprising:

an upstanding blade having a pair of side ends, a length, and a bottom;

a first scraping surface extending along the length of the blade adjacent the bottom, the first scraping surface inclined rearwardly with respect to the blade at an acute angle above the groundplane;

an upstanding wing attached to each side end of the blade and extending forwardly from the blade, each said upstanding wing having a base;

a second scraping surface attached to each wing adjacent the base;

an upstanding wedge-shaped center portion connected to the blade intermediate the side ends, the wedge-shaped center portion forming a forwardly extending wedge and having an underside; and an adjustable third scraping surface adjustably connected to the wedge-shaped center portion adjacent the underside for height adjustments above the groundplane.

2. An asphalt spreader according to claim 1 further including:

a pair of wheels, each adjustably connected adjacent one of said side ends, for adjusting the height of the blade above the groundplane.

3. An asphalt spreader according to claim 2 further including:

a control means, connected to each wheel and the blade, for controlling the height of the blade above the groundplane.

4. An asphalt spreader according to claim 3 wherein the control means includes a hydraulic system.

* * * * *